US006722109B1

(12) United States Patent
Focke et al.

(10) Patent No.: US 6,722,109 B1
(45) Date of Patent: Apr. 20, 2004

(54) SOFT PACKAGE FOR CIGARETTES AND METHOD AND DEVICE FOR MAKING SAME

(75) Inventors: Heinz Focke, Verden (DE); Henry Buse, Visselhövede (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/831,961

(22) PCT Filed: Nov. 9, 1999

(86) PCT No.: PCT/EP99/08590

§ 371 (c)(1),
(2), (4) Date: May 14, 2001

(87) PCT Pub. No.: WO00/29292

PCT Pub. Date: May 25, 2000

(30) Foreign Application Priority Data

Nov. 16, 1998 (DE) ..... 198 52 693

(51) Int. Cl.[7] ..... B65B 43/10; B65B 43/60; B65B 7/20

(52) U.S. Cl. ..... 53/575; 53/375.9; 53/376.7

(58) Field of Search ..... 53/575, 579, 375.9, 53/376.2, 376.7, 376.8

(56) References Cited

U.S. PATENT DOCUMENTS

| | | | | |
|---|---|---|---|---|
| 3,545,172 A | * | 12/1970 | Ostendahl | 53/575 |
| 4,495,750 A | * | 1/1985 | Fox | 53/575 |
| 4,508,218 A | | 4/1985 | Focke et al. | |
| 4,852,335 A | * | 8/1989 | Focke et al. | 53/575 |
| 5,176,605 A | * | 1/1993 | Focke | 493/31 |
| 5,249,416 A | * | 10/1993 | Adams et al. | 53/463 |
| 5,588,286 A | * | 12/1996 | Focke et al. | 53/575 |
| 5,732,533 A | | 3/1998 | Focke et al. | |
| 5,806,289 A | * | 9/1998 | Sassi et al. | 53/575 |
| 5,819,501 A | * | 10/1998 | Albrecht et al. | 53/226 |
| 5,970,682 A | * | 10/1999 | Focke et al. | 53/53 |
| 5,979,140 A | * | 11/1999 | Focke et al. | 53/234 |
| 5,996,309 A | * | 12/1999 | Focke et al. | 53/228 |

FOREIGN PATENT DOCUMENTS

| | | |
|---|---|---|
| DE | 2 219 540 | 10/1973 |
| DE | 21 24 118 A1 | 2/1983 |
| DE | 42 35 439 A1 | 4/1993 |
| DE | 185 35 649 A1 | 3/1997 |
| DE | 196 41 151 A1 | 4/1998 |
| EP | 0 514 203 A | 11/1992 |

OTHER PUBLICATIONS

Copy of PCT International Search Report.
Copy of European Search Report.
Copy of German Search Report.
2244 Research Disclosure (1990) Jan., No. 309, New York, US (Anordnung zum Verpacken von Zigaretten oder ahnlichen stabformigen Gegenstanden).

* cited by examiner

*Primary Examiner*—Rinaldi I. Rada
*Assistant Examiner*—Gloria Weeks
(74) *Attorney, Agent, or Firm*—Technoprop Colton LLC

(57) ABSTRACT

A soft pack for cigarettes comprises a, for example, carton-form wrapper made of paper or similar packaging material. Folding tabs, namely border strips (18 and 19) on the one hand, base tabs, namely longitudinal tabs (24 and 25) on the other hand, and also a band (or revenue stamp) (32) are connected to one another or to the pack by adhesive bonding, use being made of hot-melt adhesive which is applied in the correct position to a material web for producing blanks for the packs, is set and, once the folds or packs have been completed, is reactivated by heat. The relevant folding tabs or band are/is respectively connected to one another or to the pack by pressure.

32 Claims, 9 Drawing Sheets

31
38
35
34
36
37
19
40
42
41
21
20
23
22
39
29
46
12
25
25
30
14
27
27
44
28
13
24
24
18
26
26
31
47
45
43
11

55
10
10
60
72
52
VI
VII
10
56
57
105
91
98
110
92
112
97
103
VII
99
104
93
95
94
111
96
114
100
90
106
121
112
24 V
400 V
101
107
103
113
109
102
89

93
10
12
56
16
VII
VII
65
62
64
VIII
VIII
32
72
76
75
85
10
75
52
59
10
55
58
61
60
10
16

SOFT PACKAGE FOR CIGARETTES AND METHOD AND DEVICE FOR MAKING SAME

BACKGROUND OF THE INVENTION

1. Technical field

The invention relates to a soft pack comprising at least one blank made of paper or similar packaging material, in particular a soft-carton pack for cigarettes, having blank regions, folding tabs, etc. which are connected to one another by adhesive bonding. The invention also relates to a process and to an apparatus for producing such packs having folding tabs connected by adhesive bonding or thermal sealing.

2. Prior Art

The constantly increased output capacity of packaging machines results in problems with the gluing of folding tabs and other parts of the packs. Glue subassemblies for applying (cold) glue are the cause for frequent breaks in operation on account of soiling in the region of the glue subassembly or of the packs themselves.

BRIEF SUMMARY OF THE INVENTION

The object of the invention is to propose measures which ensure precise, disruption-free and efficient handling of the gluing of (cigarette) packs.

In order to achieve this object, the pack according to the invention is characterized in that the blank regions, folding tabs, etc., in particular side tabs and/or base tabs, are connected to one another by hot-melt glue, it being the case that applications of glue, in particular strips of glue, are applied to the non-folded and planar blank, and are activated by the feed of heat during the production process.

Provided in the region of a base wall of a soft-carton pack is 30 a specific application of glue which results in increased sealing. For the purpose of connecting base tabs, namely longitudinal tabs and side tabs, use is made of a double-T-shaped application of glue with a longitudinal strip for connecting the longitudinal tabs and with transverse strips for connecting the longitudinal tabs to inner side tabs.

A special feature is that a band (or revenue stamp) which is conventional in the case of cigarette packs is connected to the pack by hot-melt glue. According to the invention, the front and rear walls of the pack or of the soft carton are provided with areas of glue which serve for connecting the band to the pack.

The gluing of the packs according to the invention can be integrated in a conventional packaging machine, in particular in a soft-pack packaging machine. It is expedient in this case to activate expanses of glue at different locations as the folding and production process progresses and to connect the corresponding blank parts to one another. It is advantageous for the base wall to be glued in the region of a folding turret. Border strips for forming a side wall may be glued in the region of the folding turret or advantageously in the region of a separate activating turret. In the region of the latter, a band is also provided and fastened by the use of hot-melt glue.

The invention is also concerned with a specific configuration of the (activating) turret, which is provided with elongate pockets for receiving a plurality of packs in an axis-parallel position, the pockets having heating elements for local heating of the packs. In this process the heating elements or heating jaws can be used for the reactivation of the correspondingly formed glue or for the thermal sealing of folding tabs or other pack parts, with the folding tabs or the like, which are to be joined together by sealing, being comprised of thermally sealable plastic or having such layers.

A special feature is also constituted by the configuration of the turrets as far as the feed of supply and control lines as well as the control of a multiplicity of controllable elements of the turret are concerned.

BRIEF DESCRIPTION OF THE DRAWINGS

Further (special) features of the packs, of the production process and of the apparatus are explained in more detail hereinbelow with reference to the drawings, in which.

DETAILED DESCRIPTION OF THE PREFERRED EMBODIMENTS

Figure 2:
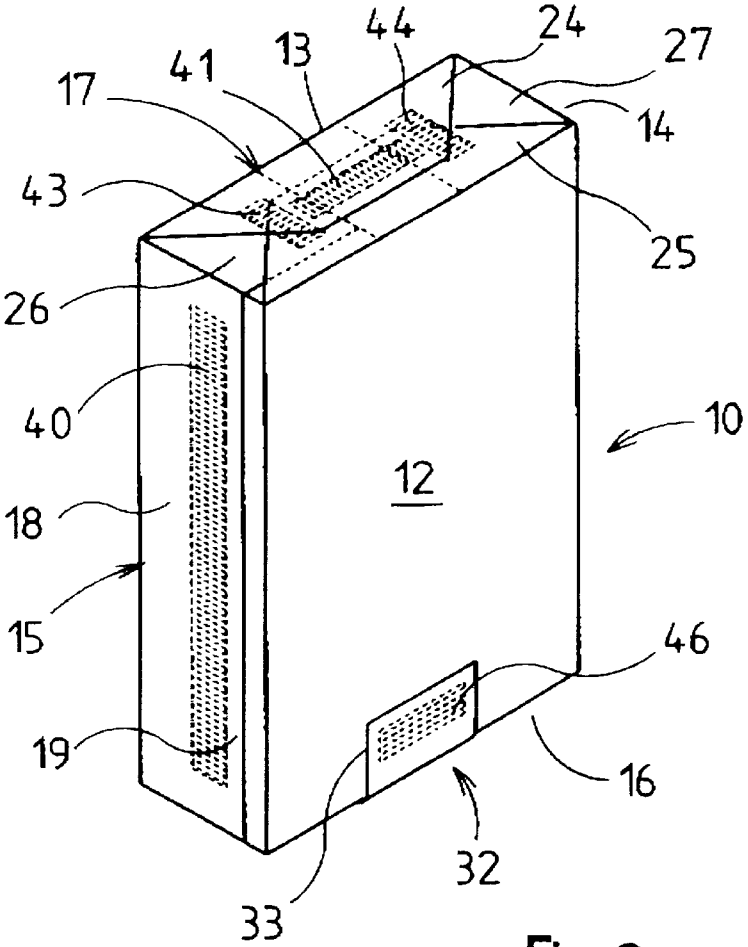
FIG. 2 shows a view of the bottom of the pack according to FIG. 1.
Figure 1:
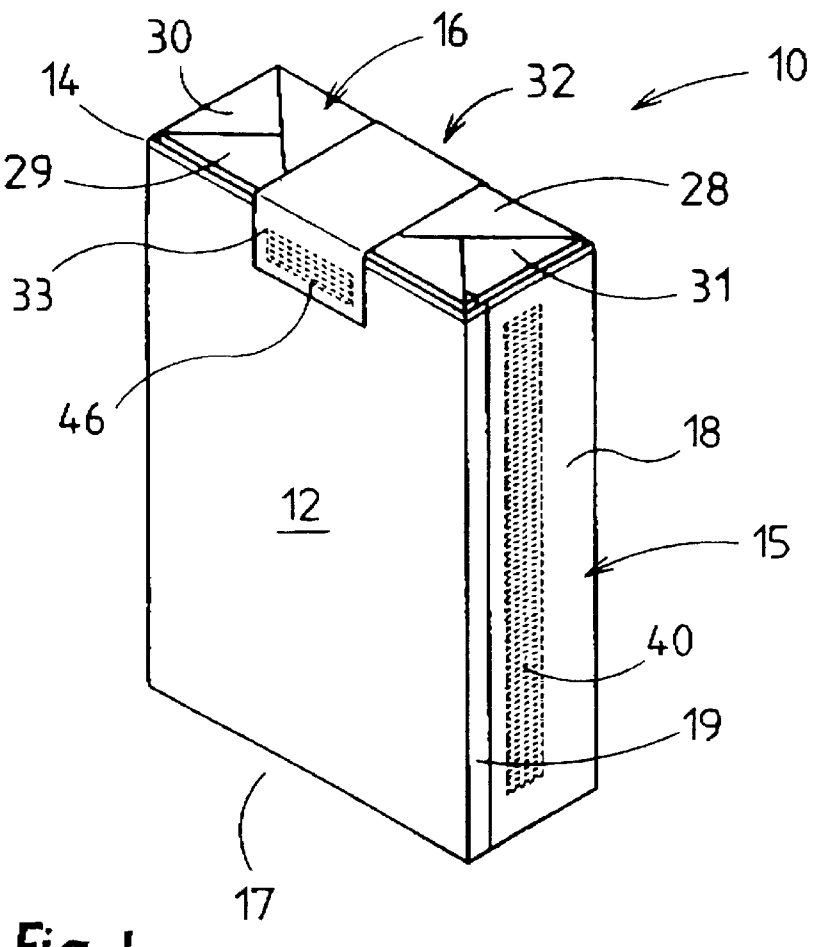
FIG. 1 shows a perspective illustration of a cigarette pack of the soft-carton type.
Figure 3:
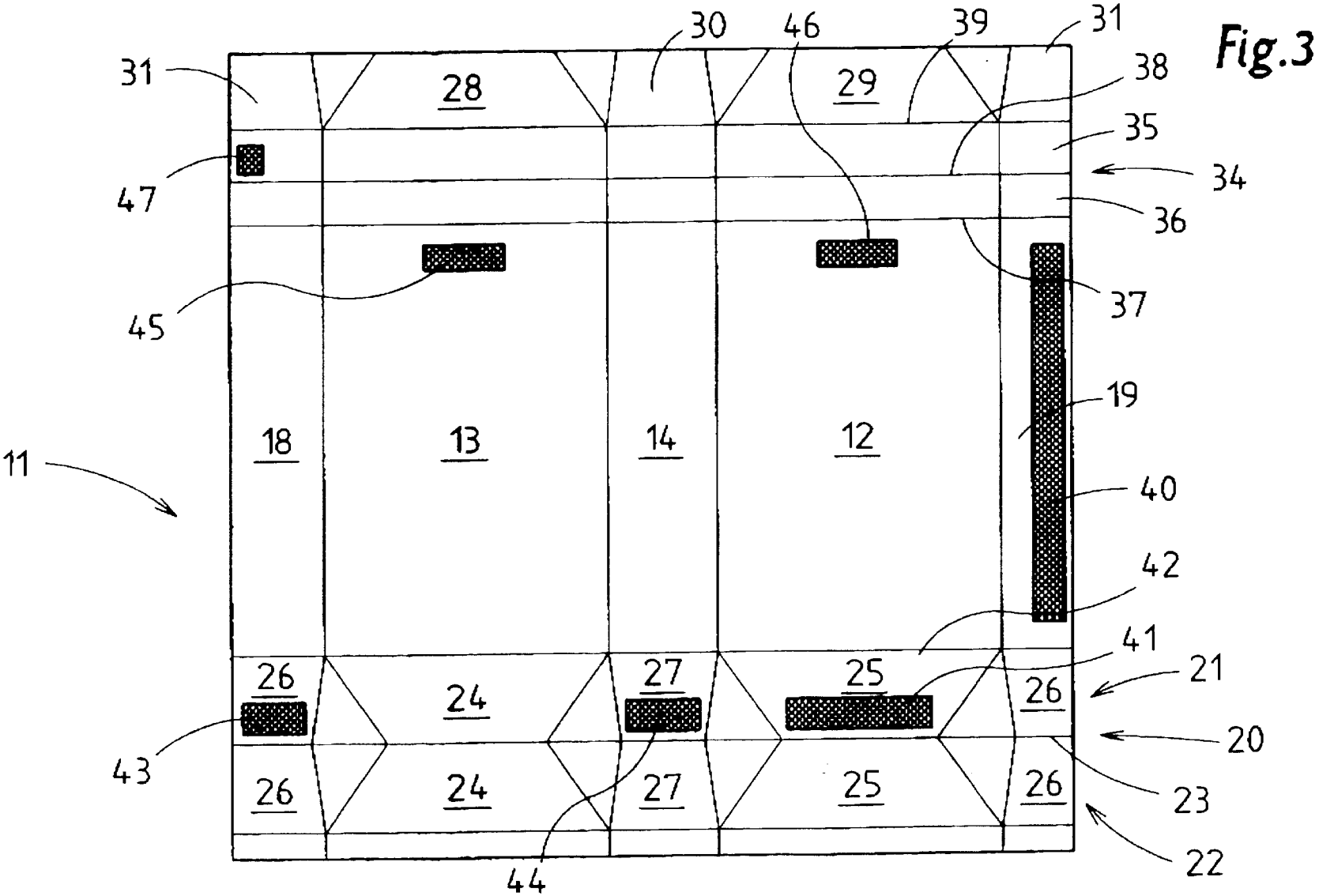
FIG. 3 shows a spread-out blank for a pack according to FIGS. 1 and 2.

FIGS. 1, 2 and 3 show special features of a cigarette pack of the (modified) soft-carton type, The (cigarette) pack 10 comprises a single-piece blank 11 made of paper or similar packaging material. The blanks 11 are severed from a wound material web in the region of the packaging machine and fed to the packaging process.

The pack 10 is more or less cuboidal with a front wall 12, rear wall 13, mutually opposite, narrow side walls 14, 15 and an end wall 16 and base wall 17. The side wall 15 comprises partially overlapping border strips 18, 19 of the blank 11.

A special feature of the pack 10 is that the base wall 17 is of double-layered design. A folding strip 20 on the border of the blank 11 forms the two layers 21, 22 in each case. The double-layered formation is formed by virtue of folding over along a folding line 23. On account of corresponding folding, the double-layered folding strip 20 then forms trapezoidal longitudinal tabs 24, 25 and inner side tabs 26, 27 adjoining the side walls 14, 15.

The end wall 16 is of analogous, but single-layered, design. Trapezoidal longitudinal tabs 28, 29 overlap partially. Side tabs 30, 31 connected to the side walls 14, 15 are folded beneath said longitudinal tabs.

A band 32 which is folded in a U-shaped manner and is made of thin paper or the like extends transversely over the end wall 16. The band 32 has its legs 33 connected to the front wall 12 and rear wall 13 in each case by adhesive bonding.

An encircling double fold extends beneath the end wall 16. Said double fold is formed from a material strip 34 by Z-shaped folding. In this case, folding legs are folded on the inner side of the blank 11 such that the two folding legs 35, 36 butt against one another, the bottom folding leg 36 butting directly against the inner side of the blank. A bottom folding line 37 forms the top border of the front wall 12, rear wall 13, etc. A central folding line 38 is located at a correspondingly lower level and a top folding line 39 forms the transition to the end wall 16. The configuration of the pack 10 described thus far corresponds to that according to U.S. Pat. No. 5,762,186.

The blank 11 is provided prior to the folding operation, in particular in the region of a continuous material web, with selected areas of glue, to be precise comprising glue (hot-melt glue) which sets at room temperature and can be activated by elevated temperature.

A first strip of glue 40 extends on the outer side of the inner border strip 19 for the side wall 15. A transversely directed strip of glue 41 serves for connecting the base-side longitudinal tabs 24 and 25. The strip of glue is arranged on the outer side of the inner longitudinal tab 25, to be precise in a region 42 of the double-layered longitudinal tab 25, said region being directed towards the front wall 12. In the region of this layer 21, further regions of glue 43 and 44 are arranged in the region of side tabs 26 and 27. These regions of glue 43, 44 extend—as does the strip of glue 41—over more or less the entire free dimension of the relevant folding tab. When folding of the base wall 17 has been finished, the regions of glue 43, 44 extend transversely to the strip of glue 41, to be precise adjoining the latter. The regions of glue 43, 44 connect the side tabs 26, 27 to sub-regions of the longitudinal tabs 24 and 25 for the purpose of providing a largely sealed base wall 17.

Regions of glue 45 and 46 are applied in the region of the front wall 12 and rear wall 13, said regions of glue serving for adhesively bonding the band 32 or the legs 33. Finally, a spot of glue 47 is arranged in the region of the material strip 34, to be precise on the folding leg 35. The spot of glue 47 is located in the region of the overlap of the end regions of the Z-fold, that is to say in the region of the side wall 15. The spot of glue 47 connects the outer layers or folding legs 35, 36 of the Z-fold.

All the areas of glue 40, 41, 43 . . . 47 are applied to the outer, that is to say printed, side of the blank 11.

Figure 4:
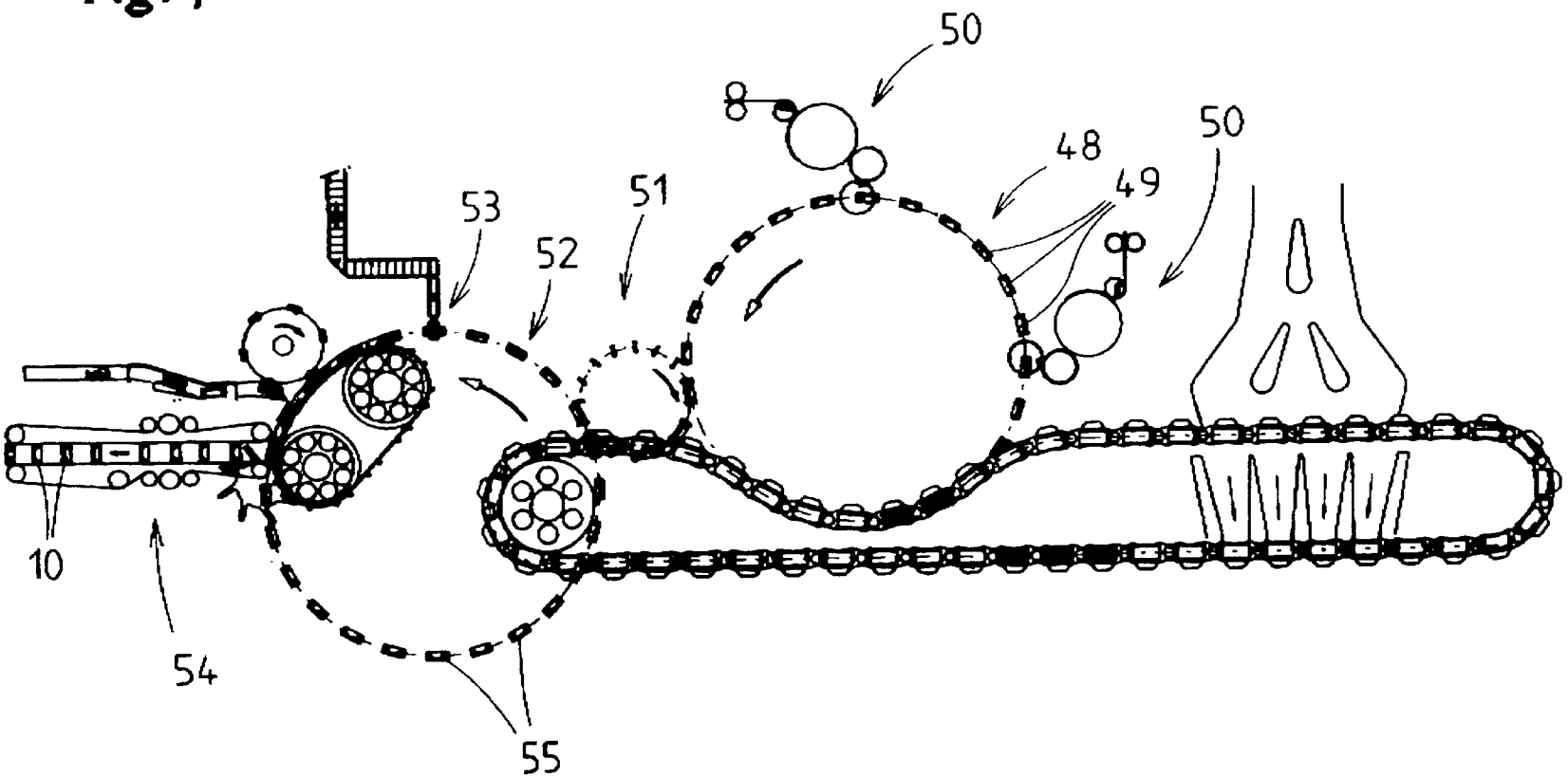
FIG. 4 shows a schematic side view of a packaging machine for producing soft packs for cigarettes.

The expanses of hot-melt glue are activated, during folding of the blank 11 or once the pack 10 has been more or less finished, by the feed of heat and are fixed by pressure. FIG. 4 shows schematically the construction of a packaging machine for producing packs 10. A central folding turret 48 serves for producing the pack 10 and for filling the same. The blanks 11 in this case are folded on the outer side of folding mandrels 49, that is to say thin-walled hollow bodies which are open at both ends. In the case of the specific design of the blank according to FIG. 3, pre-folding, namely the formation of the double-layered folding strip 20 and the Z-folding in the region of the material strip 34, takes place outside the region of the folding turret 48. The material web prepared in this way is fed to a blank subassembly 50 for the purpose of severing the blanks and for transfer to the folding mandrels 49 of the folding turret 48.

When folding of the blanks 11 or packs 10 has been finished, the packs leave the folding turret 48 in the region of a transfer turret 51. The latter transports the packs 10, with some of the folding tabs already glued or without prior gluing, into the region of a special activating turret 52. In the region of the latter, all, or selected, areas of glue are activated by heat. Folding tabs are connected to one another by pressure. In the region of the activating turret 52, the bands are also fed, to be precise by a band apparatus 53 The subsequently finished packs leave the activating turret 52 via a removal conveyor 54. The transfer turret 51 may be designed in accordance with U.S. Pat. No. 5,758,468. Details of the activating turret 52 and of the removal conveyor 54 can be gathered from U.S. Pat. No. 5,544,467.

Figure 5:
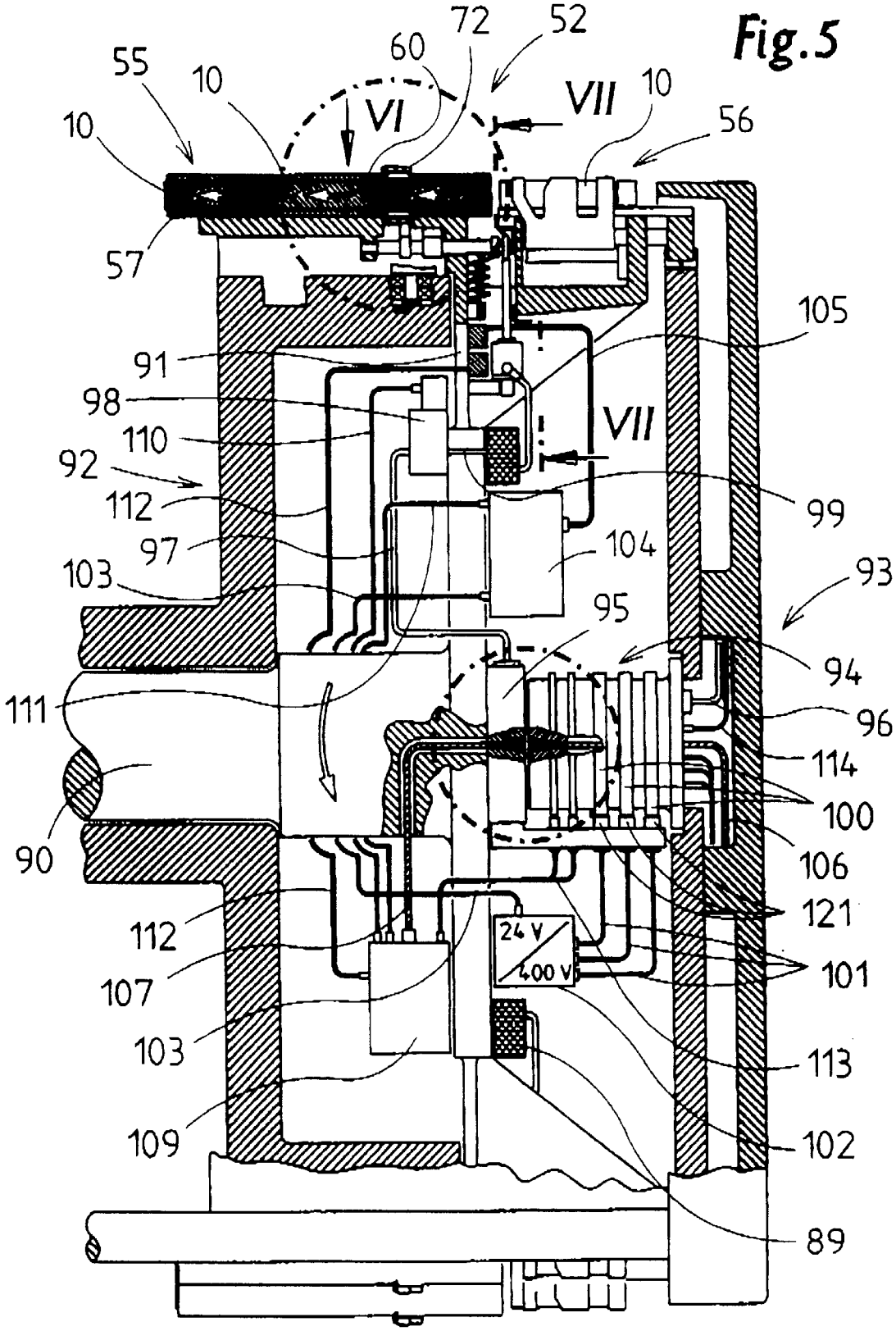
FIG. 5 shows, on an enlarged scale, a detail of the packaging machine, namely an activating turret, in axial section.

The activating turret 52 comprises a plurality of (namely 24) axis-parallel, elongate, channel-like pockets 55 arranged along the circumference. Each of these pockets 55 serves for receiving a plurality of, namely three, packs 10 located one beside the other in the longitudinal direction, said packs butting against one another by way of the end walls 16 and base walls 17. In the region of a transfer station, in each case a new pack 10 is pushed into a pocket 55 by a pusher. At the same time, a (finished) pack 10 is ejected on the opposite side (left-hand side in FIG. 5). Located in a region in front of the push-in opening of the pocket 55, adjacent to each pocket 55, is a receiving pocket 56 for receiving in each case one pack 10 from the transfer turret 51. By virtue of displacement in the axis-parallel direction, the pack 10 passes from the receiving pocket 56 into the pocket 55, in a manner analogous to U.S. Pat. No. 5,544,467.

The pockets 55 of the activating turret 52 enclose the packs 10 on a number of sides, to be precise such that the precise cross-sectional shape of the packs 10 is maintained and stabilized. In the case of the example shown, each pocket 55 comprises a radially inner wall 57, more or less radially directed outer walls 58, 59, which are located opposite one another in the circumferential direction, and a radially outer top wall 60. The latter extends over a sub-region of the packs 10 so as to produce a slot-like opening 61 running in the longitudinal direction of the pockets 55.

In the region of the activating turret 52, namely in the pockets 55, hot-melt glue of the packs 10 is reactivated by heat. The relevant folding tabs or pack parts are connected to one another by virtue of being pressed. There is sufficient time for consolidating the connection because each pack 10 remains in the activating turret 52 through three revolutions of the latter.

Figure 7:
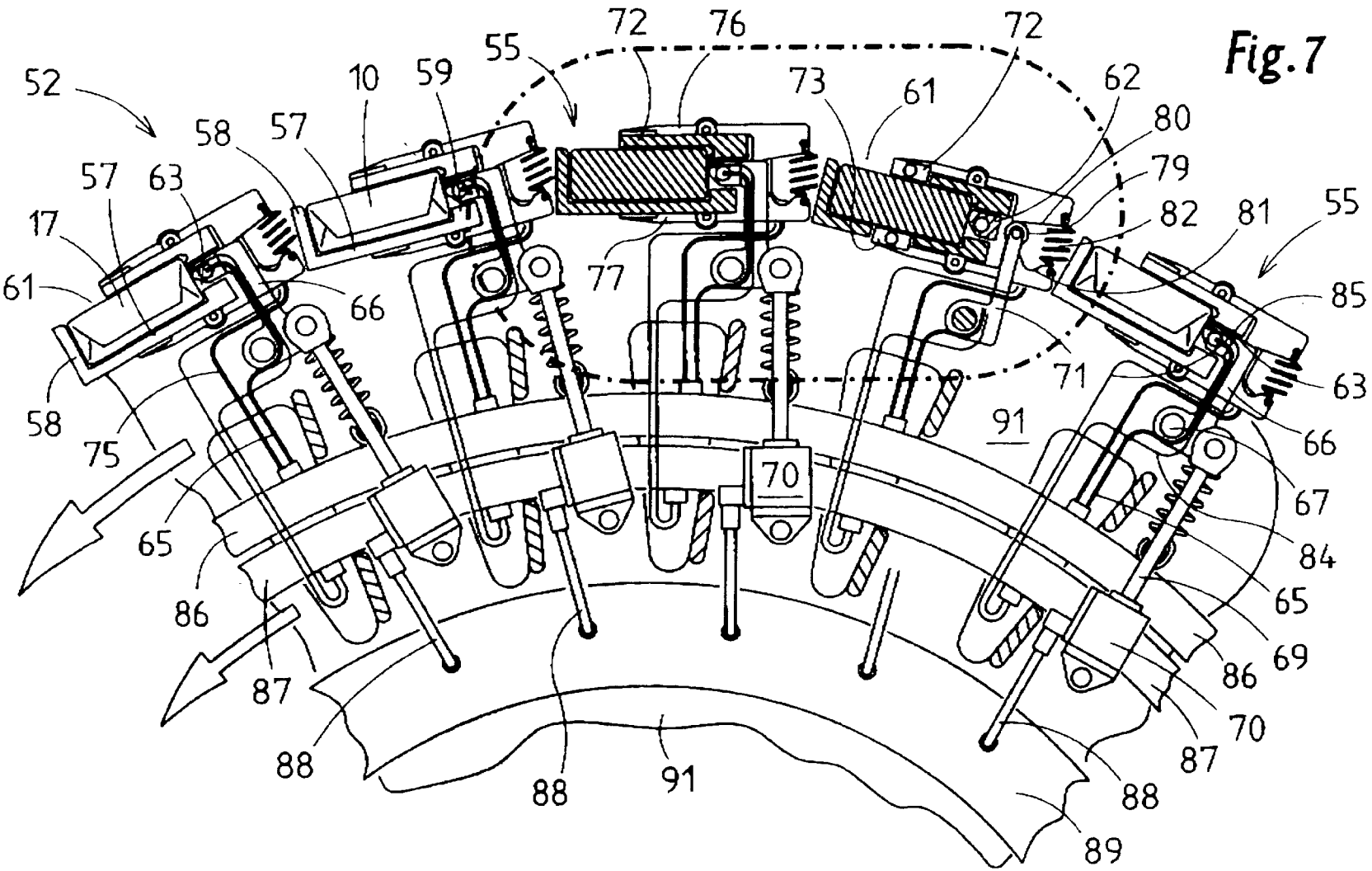
FIG. 7 shows part of the activating turret in the circumferential region in a section VII—VII, transverse to the axis, from FIGS. 5 and 6.
Figure 8:
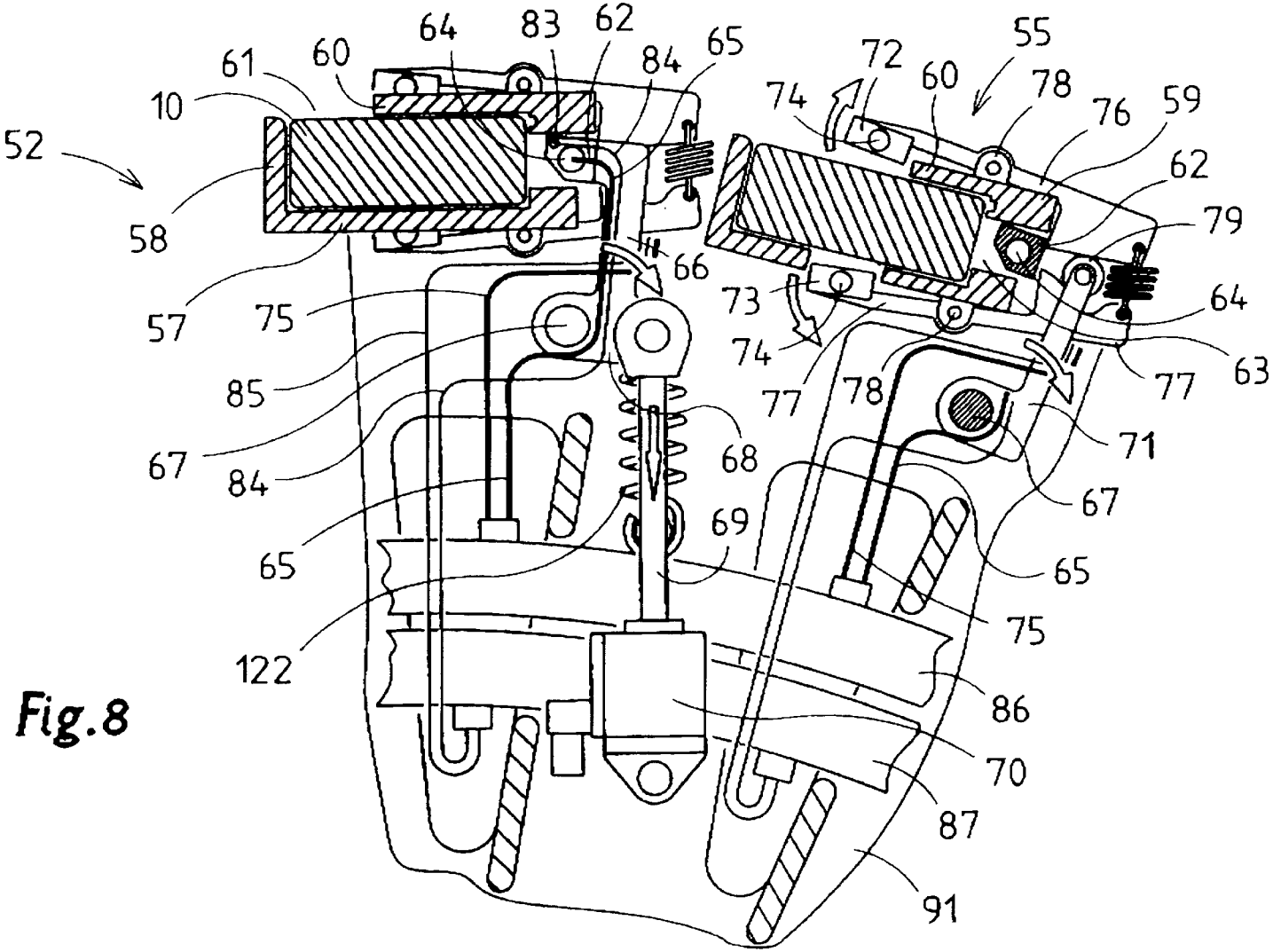
FIG. 8 shows, on a further-enlarged scale, part of the turret corresponding to FIG. 7 in an offset sectional plane VIII—VIII, transverse to the axis, from FIG. 6.

The strips of glue 40 are reactivated in the region of the pockets 55 and the border strips 18, 19 are connected to one another. For this purpose, a reactivating element, namely an elongate heating jaw 62, is provided in the region of an outer wall 59. Said heating jaw extends merely over part of the length of the pocket 55 or of the outer wall 59, corresponding to the length of a pack 10, namely of the pack 10 which is the last to be pushed into the pocket 55 in each case. The heating jaw 62 is an elongate, narrow element which is located in a movable manner in a slot 63 of the outer wall 59, to be precise in a relative position which corresponds to the position of the strip of glue 40. The heating jaw 62 can be moved transversely to the outer wall 59, namely from a retracted position, in which it is at a distance from the pack 10 (FIG. 8), into an activating position, in which it butts against the pack 10 or against the outer border strip 18 (FIG. 7). In this position, heat is transmitted to the pack 10 or the blank 11.

The heating jaw 62 can be heated. For this purpose, an elongate heating cartridge 64 is arranged in a corresponding bore of the heating jaw 62. The heating cartridge 64 is heated via an electric heating line 65.

Figure 9:
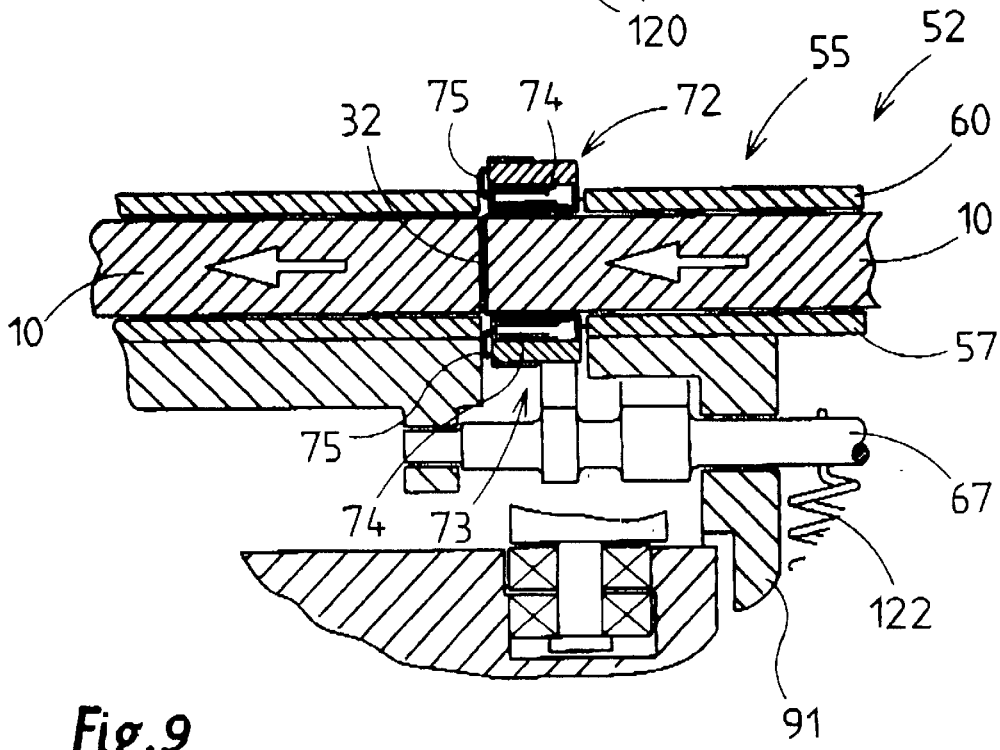
FIG. 9 shows, on an enlarged scale, a detail of a radially outer region of the activating turret in axial section.

The heating jaw 62 is provided on an actuating element, namely on a lever 66. The latter is of angled configuration. The heating jaw 62 is located on a transversely directed leg. The lever 66 is mounted in a pivotable manner and, for this purpose, on a rotatable actuating rod 67. The latter—in the same way as a shaft—is mounted rotatably on the turret, that is to say on the radially inner side of the pockets 55, on the one hand, and in the region of a turret plate 91, on the other hand (FIG. 9).

The axis-parallel actuating rods are connected to an actuating element which acts on a lateral extension 68 of the actuating rod 67. A thrust rod 69 of a (pneumatic) cylinder 70 is connected in an articulated manner to the extension 68 and thus to the actuating rod 67. Each pocket 55 is assigned such a cylinder 70. The cylinders 70 are mounted pivotably in the activating turret 52, to be precise on the turret plate 91. By virtue of the thrust rod 69 being extended, the respective lever 66 is actuated in the anticlockwise direction and the heating jaw 62 is moved into a heating and pressure-exerting position.

Figure 6:
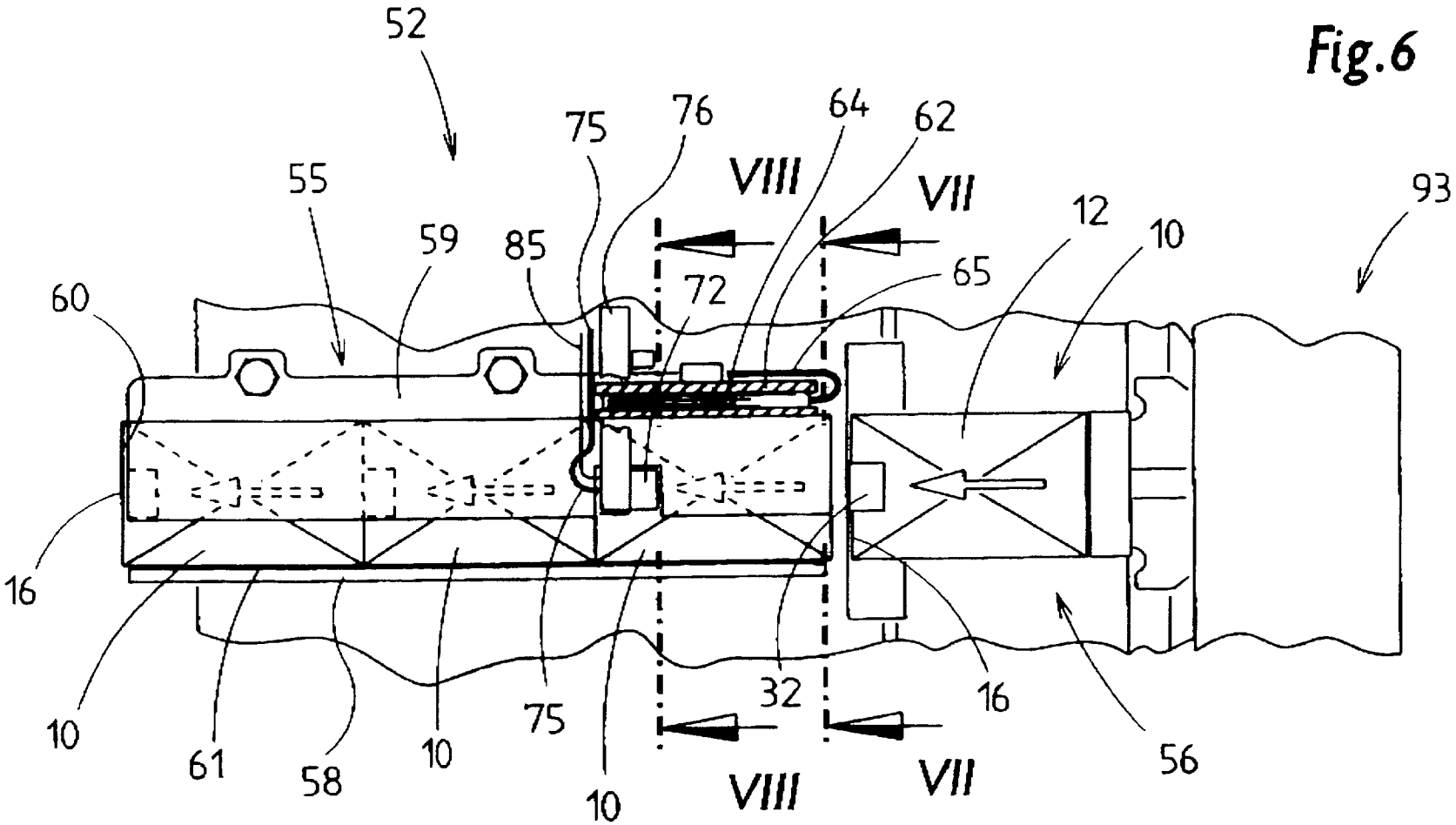
FIG. 6 shows a detail of the activating turret according to FIG. 5 in a radially directed view in accordance with arrow VI in FIG. 5.

The activation of the regions of glue 45, 46 on the front wall 12 and rear wall 13—for the purpose of fastening the band 32—likewise takes place in this region of the pockets 55. The band 32 is folded around the end wall 16 of the packs 10 in a U-shaped manner when the packs 10 are pushed into the pockets 55 (or even before this) (FIGS. 6 and 9). The radially outer and inner legs 33 of the band 32 are located in the region of the regions of glue 45, 46.

Appropriate elements, namely radially outer and inner plate-like heating shoes 72, 73 are provided in order to activate the regions of glue 45, 46 and to press on the band 32. Said heating shoes can be pressed against the packs, to be precise in the region of the legs 33 of the band 32. Each heating shoe 72, 73 is provided with a heating cartridge 74 which is supplied via an electric heating line.

Each heating shoe 72, 73 is provided in an actuating element, namely on a (two-armed) pivot lever 76, 77. Rotary bearings 78 for said pivot lever 76, 77 are located on the outer side and inner side of the pockets 55.

For actuation purposes, free end regions of the pivot levers 76, 77 are activated, in the present case by a common actuating element which causes the ends of the pivot levers 76, 77 to spread apart in order to move the heating shoes 72, 73 into the heating and pressing position. The spreading element is a roller 79 which can be moved back and forth, in the circumferential direction of the activating turret 52, between the end regions of the pivot levers 76, 77. These are designed as curved paths, namely with a top or outer essentially rectilinear curved path 80 on the pivot lever 76 and with a curved path 81 having an elevation and depression on the radially inner pivot lever 77. In FIG. 7, the roller 79 is located in the spreading position, in which the heating shoes 72, 73 are in the activating position. The roller 79 is located in this case between those regions of the curved paths 80, 81 which are closest together. Movement back into a depression of the curved path 81 releases the pressure-exerting position of the heating shoes 72, 73. A tension spring 82 between the ends of the pivot levers 76, 77 causes the latter to open.

The roller 79 is provided at the free end of an actuating lever 71. The latter, in turn, is mounted on a common actuating rod 67. By virtue of rotary movement of the actuating rod 67, initiated by an extending or retracting movement of the thrust rod 69, the actuating rod 67 is rotated in one direction or the other, as result of which, on the one hand, the lever 66 and, on the other hand, the actuating lever 71 are pivoted in the same direction. The corresponding movement of the actuating lever 71 results in the above-described movement of the roller 79 and thus in the actuation of the heating shoes 72, 73. Accordingly, the latter are always brought into position together and at the same time as the heating jaw 62. By virtue of a tension spring 122, the abovedescribed levers, and thus the heating and pressure-exerting elements, are always loaded in the direction of a retracted, open position.

In the case of this example, the adhesive bonding in the region of the base wall 17, that is to say the reactivation of the strip of glue 41 and of the regions of glue 43 and 44, takes place in the region of the folding turret 48, namely on the folding mandrels 49. In this case, the folding tabs of the base wall 17 are brought into the folding position. Outer and inner heating and pressure-exerting elements bring about the adhesive bonding of the folding tabs to one another in a manner analogous to EP 0 835 810.

A further special feature is that each heating element, namely each heating jaw 62 and each heating shoe 72, 73, is assigned a sensor 83, namely a heating sensor for establishing the temperature at any given moment in time. The sensors 83 are connected, via sensor lines 84, 85 to a central control unit in which the respectively measured temperature is evaluated and, if appropriate, temperature is changed via the heating cartridges 64, 74. For the sake of simplicity, the sensors of the heating shoes 72, 73 are not shown, but the sensor lines 85 are.

As far as the arrangement and guidance of lines for current and flowing media are concerned, the (activating) turret 52 is of a specific design. Annular cable ducts, in the present case two cable ducts 86, 87, receive the multiplicity of electric lines which are necessary for the large number of supply locations, namely the heating elements, on the one hand, and the sensors, on the other hand. In the case of the present example, each pocket 55 is assigned two electric lines for the heating elements and two cables for the sensors. The cable duct 86 receives connection lines for the heating lines 65 and 75. The cable duct 87 is assigned to the sensor lines 84 and 85. The relevant lines run in bundled form within the cable duct.

Furthermore, pressure-medium lines, namely compressed-air lines 88, lead to each of the cylinders 70. The compressed-air lines 88 are also bundled in a central collecting element, namely in an annular line duct 89. Accordingly, the latter contains a number of compressed-air lines 88 which correspond to the number of cylinders 70. The compressed-air lines 88 lead as a branching means from the line duct 89 to each cylinder 70.

As far as the feed of (compressed) air and current and the feed of control signals are concerned, the activating turret 52 Is of a specific design. Provided at the end of a main shaft 90 is a radially directed, rotating supporting element of the turret, namely a turret plate 91 which is directed transversely to the main shaft 90. Said turret plate is provided with cutouts and transverse ribs (FIGS. 7 and 8) and supports for a number of elements. The cable ducts 86, 87 and the line duct 89 are also provided on this turret plate 91. On the outside in the radial direction, the pockets 55, directed parallel to the main shaft 90, are provided on the turret plate 91. The main shaft 90 is mounted rotatably in a cup-like housing part 92. The housing part 92 is arranged in a fixed manner and is provided on the outer circumference, inter alia, with curved grooves for control elements.

A fixed part 93 is arranged opposite the rotatable part of the activating turret 52. Said fixed part is provided centrally with a hub 94. Directly opposite the hub 94, or an end surface of the same, a cylindrical mating member 95 is provided on the rotating part of the turret, namely on the main shaft 90 or on the turret plate 91.

The hub 94 and mating member 95 serve for transmitting the compressed air from the fixed part 93 to the rotating part of the turret. For this purpose, a feed line 96 leads via the hub 94 to the mating member 95. From said rotating part, the compressed air is discharged to a main line 97 which feeds the compressed air—for all the cylinders 70—to a central valve block 98. The latter is connected via connecting lines 99, which are assigned to each cylinder 70, to the compressed-air lines 88 within the line duct 89. The valve block 98 is provided with a valve for each cylinder 70 and/or for each connecting line 99, with the result that the feed of compressed air to the individual cylinders 70, and thus the actuation of the same, is controlled via the valve block 98.

The current supply is also brought about via the hub 94 with the rotating mating member 95, to be precise via (three) slip rings 100. The current, in particular for the heating means, is taken off from the slip rings 100 via sliding contacts 121 and fed, via current-conducting lines 101, to a co-rotating transformer 102 fastened on the turret plate 91. From said transformer 102, a (24-V) line 103 leads to a control box 104 which is likewise provided on the rotating part of the turret, namely on the turret plate 91. From the control box 104, in turn, electric connecting lines 105 lead to the heating means of each pocket 55. Accordingly, in the present case there are 24 such connecting lines 105, or a corresponding multi-core connecting line 105, which lead to the cable duct 86 or to the lines which run within the cable duct and are assigned to the heating lines 65, 75. Accordingly, the current is transported over this path to the heating means in the region of the pockets 55.

Figure 10:
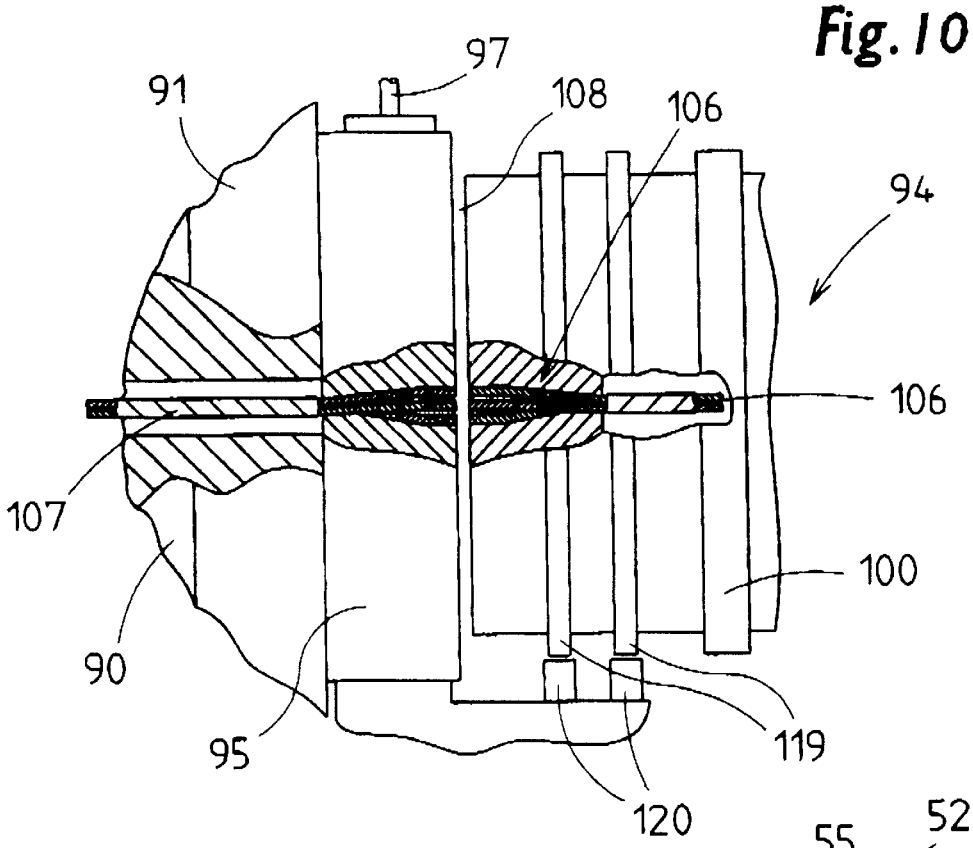
FIG. 10 shows, on an enlarged scale, part of FIG. 5 in the central region of the activating turret.

Control signals are transmitted in a specific manner to the various elements which are to be controlled. Since individual control signals have to be transmitted for each of the elements assigned to the pockets 55, a contactless connection for transmitting a multiplicity of control signals is provided between the hub 94 and mating member 95. In the case of the exemplary embodiment according to FIGS. 5 and 10, the control signal 5 are transmitted as light signals, to be precise by light-conducting lines 106 and 107 running centrally in the hub 94 and in the mating member 95. In the region of the transition from the (fixed) light-conducting line 106 to the (rotating) light-conducting line 107, two lengths of the two light-conducting lines 106, 107 are arranged concentrically, with the result that light signals can be transmitted constantly during the rotation of the turret, a gap 108 between the hub 94 and mating member 95 being bridged in the process.

The light-conducting line 106 is connected to a central control unit of the packing machine, from which the control signals are emitted. The light-conducting line 107, which is assigned to the rotary part, leads to a control unit 109 which is likewise provided on the turret plate 91.

Control lines lead from the control unit 109 to the appropriate elements. A first (multi-core) control line 110 leads to the valve block 98 and serves for actuating the valves in the valve block 98 which are assigned to the cylinders 70. Another (multi-core) control line 111 leads to the control box 104 for the transmission of the heating current. This control line 111 transmits signals for switching on and off the heating means for each pocket 55 or for changing the heating resistance.

A third (multi-core) control line 112 leads from the control unit 109 to the cable duct 87. Each core of said control line 112 is connected, in the region of the cable duct 87, to a line assigned to the sensor lines 84, 85. The measured temperatures are thus fed to the control unit via the control lines 112 and evaluated there as far as the feed of current to the heating means is concerned.

The control unit 109 has its own power supply (24 V). A control current-conducting line 113 leads from the slip rings 119 of the hub 94 to the control unit 109 via sliding contacts 120, with the result that, irrespective of the rest of the power supply, said control unit is always supplied with current, to be precise via a corresponding connection current-conducting line 114 in the fixed part of the turret.

Figure 11:
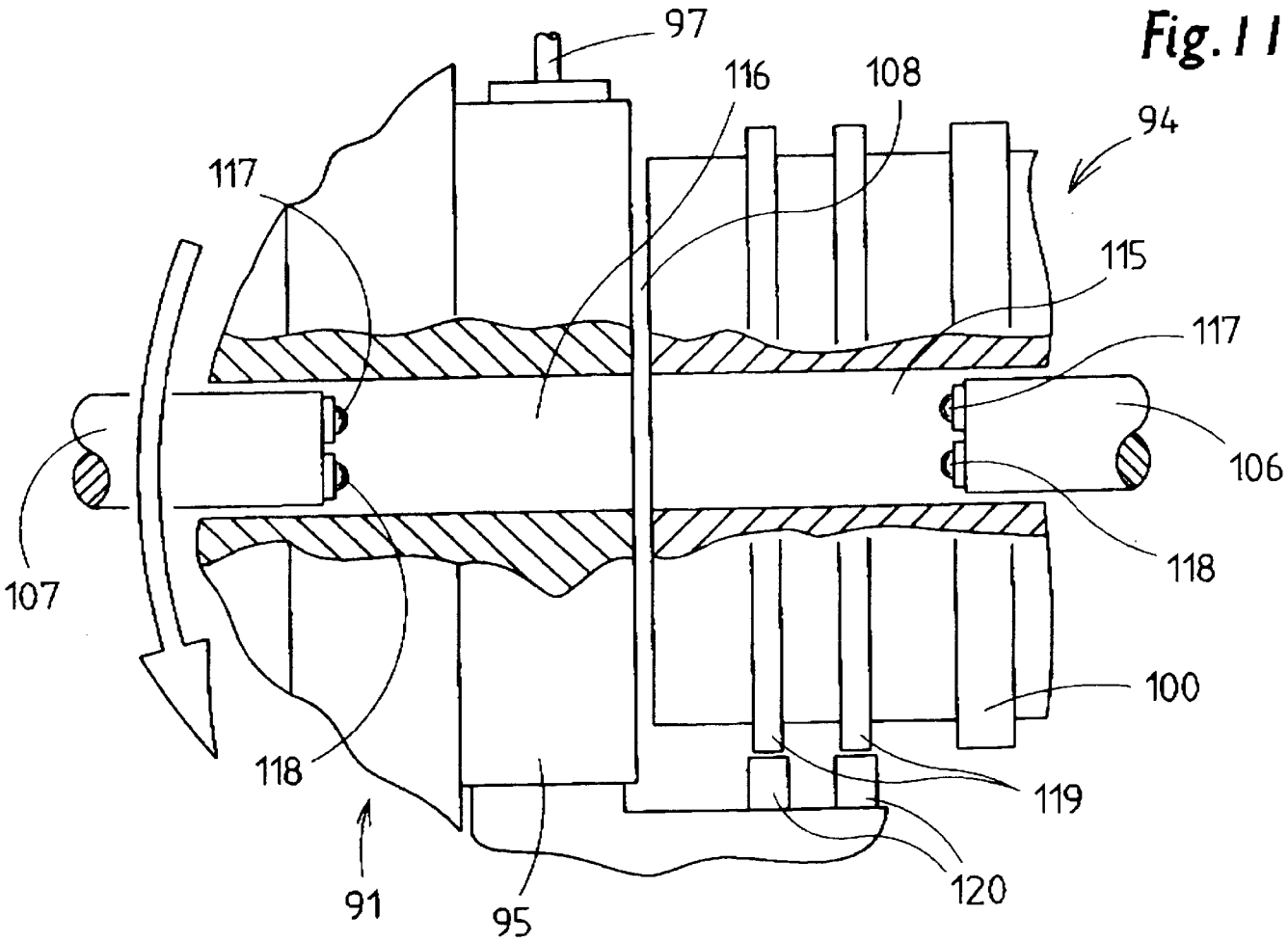
FIG. 11 shows, on a further-enlarged scale, an illustration of the detail analogous to FIG. 10 for another embodiment.

Control signals may be transmitted from the fixed part to the rotating part, that is to say from the hub 94 to the mating member 95, in a different manner, FIG. 11 shows an example in which in a central duct 115, 116 of the hub 94, on the one hand, and of the mating member 95, on the other hand, ends of light-conducting lines 106, 107 are spaced apart from one another. Transmitters 117 and receivers 118 which correspond to one another in each case are arranged at the ends of the light-conducting lines 106, 107. Said transmitters and receivers transmit and receive the light signals from one light-conducting line 106 to the other light-conducting line 107. The rotary movement of the light-conducting line 107 does not have any effect here since the light from a transmitter 117 in each case reaches the receiver 118 of the opposite light-conducting line 106, 107. Depending on the signal, the light is transmitted at different frequencies.

Alternatively, it is possible to make use of the transmission of infrared signals, which are transmitted in a manner similar to that illustrated in FIG. 11.

Finally, it is also possible to have a further variant in which signals are transmitted via the slip rings 119 of the hub 94 and sliding contacts 120 of the mating member 95, to be precise as a specific signal frequency, namely as a so-called harmonic wave (high-frequency signals) in relation to the current transmitted.

The abovedescribed configuration of a turret and the proposals for transmitting air as well as current and signals may also be used for other rotating elements. Furthermore, different solutions as far as the activation of the spot of glue 47 for fixing the Z-fold are possible. This area of glue may even be activated in the region of the material web, following production of the Z-fold, in order to produce the glued connection. Alternatively, it is possible, with a corresponding design of the heating jaw 62, to activate the spot of glue 47 by said heating jaw in order to produce the connection. Furthermore, the described apparatus or turret is particularly well-suited for connecting folding tabs or blanks by means of thermal sealing, with the heating elements or heating jaws acting as sealing elements or sealing jaws.

LIST OF DESIGNATIONS

10 Pack
11 Black
12 Front
13 Rear wall
14 Side wall
15 Side wall
16 End wall
17 Base wall

18 Border strip
19 Border strip
20 Folding line
21 Layer
22 Layer
23 Folding line
24 Longitudinal tab
25 Longitudinal tab
26 Side tab
27 Side tab
28 Longitudinal tab
29 Longitudinal tab
30 Side tab
31 Side tab
32 Band
33 Leg
34 Material strip
35 Folding leg
36 Folding leg
37 Folding line
38 Folding line
39 Folding line
40 Strip of glue
41 Strip of glue
42 Region
43 Region of glue
44 Region of glue
45 Region of glue
46 Region of glue
47 Spot of glue
48 Folding turret
49 Folding mandrel
50 Blank subassembly
51 Transfer turret
52 Activating turret
53 Band apparatus
54 Removal conveyor
55 Pocket
56 Receiving pocket
57 Inner wall
58 Outer wall
59 Outer wall
60 Top wall
61 Opening
62 Heating jaw
63 Slot
64 Heating cartridge
65 Heating line
66 Lever
67 Actuating rod
68 Extension
69 Thrust rod
70 Cylinder
71 Actuating lever
72 Heating shoe
73 Heating shoe
74 Heating cartridge
75 Heating line
76 Pivot lever
77 Pivot lever
78 Rotary bearing
79 Roller
80 Curved path
81 Curved path
82 Tension spring
83 Sensor
84 Sensor line
85 Sensor line
86 Cable duct
87 Cable duct
88 Compressed-air line
89 Line duct
90 Main shaft
91 Turret plate
92 Housing part
93 Fixed part
94 Hub
95 Mating member
96 Feed line
97 Main line
98 Valve block
99 Connecting line
100 Slip ring line
101 Current-conducting
102 Transformer
103 Line
104 Control box
105 Connecting line
106 Light-conducting line
107 Light-conducting line
108 Gap
109 Control unit
110 Control line
111 Control line
112 Control line
113 Control current-conducting line
114 Connection current-conducting line
115 Duct
116 Duct
117 Transmitter
118 Receiver
119 Slip ring
120 Sliding contact
121 Sliding contact
122 Tension spring

What is claimed is:

1. Apparatus for producing a soft-carton pack for cigarettes from at least one blank (11), with the soft-carton pack having blank regions and folding tabs that are connected to one another by adhesive bonding, and the at least one blank being folded by a folding turret (48) on hollow folding mandrels (49), characterized in that the apparatus comprises:

(a) a means for providing the at least one blank (11) with hot-melt glue, (b) a means downstream of the folding turret (48) for activating the glue of the of the folded at least one blank (11) and for connecting the folding tabs which are to be adhesively bonded, wherein the means for activating the glue is an activating turret (52) with (i) pockets (55) for receiving a plurality of the soft carton packs (10), with each pocket (55) being assigned an individually heating and pressure-exerting element that can be pressed onto the soft pack or blank (11) in the region of hot melt glue, (ii) a rotating turret part and a fixed part (93), and (iii) at least one line selected from the group consisting of lines for current supply, lines for feeding compressed air and lines for transmitting control signals between the rotating turret part and the fixed part (93) in the region of a hub (94) of the fixed part (93) and of a mating member (95) of the rotating turret part.

2. Apparatus according to claim 1, characterized in that the heating and pressure exerting elements for activating the glue wherein the heating elements are arranged in the region of each pocket (55) of the activating turret (52) and are movable relative to the pockets (55) or packs (10) and can butt against the pack (10) for the transmission of heat and pressure.

3. Apparatus according to claim 2, characterized in hat each heating and pressure-exerting element assigned to a pocket (55) has a heating cartridge (64, 74) and a heat-sensitive sensor (83) for establishing a respective temperature.

4. Apparatus according to claim 3, characterized in that electric current for supplying the heating cartridges (64, 74) of the heating and pressure-exerting elements is fed to a transformer (102), which is arranged in the rotating turret part of the activating turret (52), via a common current-conducting line (101) from the hub (94) via slip rings (100) and sliding contacts, and in that an electrical line (103) leads from the transformer to a control box (104), to which there is connected a connecting line (105) for each heating cartridge (64, 74).

5. Apparatus according to claim 4, characterized in that heating lines (65, 75) leading to the heating and pressure-exerting elements are combined to form a bundle of lines and in that the connecting lines (105) are connected to a cable duct (86).

6. Apparatus according to claim 1, characterized in that the heating and pressure-exerting elements are movable by pivotably mounted levers, such that the heating and pressure-exerting elements are actuated by a common actuating element cylinder (70) via a lever (66).

7. Apparatus according to claim 6, characterized in that the pockets (55) of the activating turret (52) have axis-parallel hollow bodies with cross-sectionally predominantly closed inner wall (57), outer wall (58, 59), and top wall (60) and in that the heating and pressure-exerting elements are arranged in the region of cutouts of the outer wall (59) and of the top wall (60).

8. Apparatus according to claim 7, characterized in that the pockets (55) of the activating turret (52) are designed for receiving a plurality of the packs (10) located one beside the other in a longitudinal direction, and in that the heating and pressure-exerting elements are positioned in the region of one of the packs (10) which has newly been pushed into the pocket (55).

9. Apparatus according to claim 8, characterized in that control signals for the elements of the rotating turret part of the activating turret (52) are transmitted in a non-contact manner by light signals a cross mutually facing ends of light-conducting line (106, 107) arranged centrally in the region of the hub (94) and of the rotating mating member (95).

10. Apparatus according to claim 9, characterized in that lengths of the light-conducting lines (106, 107) are arranged concentrically in mutually facing regions of the hub (94) wherein the light signals are respectively transmitted and received by separate transmitters (117) and receiver (118) at ends of the light conducting lines (106, 107).

11. Apparatus according to claim 10, characterized in that the light-conducting line (107) assigned to the rotary part of the activating turret (52) leads to a co-rotating control unit (109), from which control lines lead to the cylinders (70) for actuating the heat and pressure-exerting elements, to heat-sensitive sensors (83) and to heating cartridges (64, 74).

12. Apparatus according to claim 11, characterized in that sensor lines (84, 85) leading to the sensors (83) of the pockets (55) lead to a common annular cable duct (87), and in that the control lines (112) from the control unit (109) are connected to the cable duct (87).

13. Apparatus according to claim 1, characterized in that (i) a common compressed-air feed line (96) for supplying the cylinders (70) via the hub (94) and the mating member (95) is fed to a valve block (98) that is common to all the cylinders (70), (ii) in that the valve block is connected to compressed-air lines (88), assigned to each cylinder (70), for transmitting compressed air to the cylinders (70), and (iii) valve blocks (98) are controlled by control unit (109) via a control line (110).

14. Apparatus according to claim 1, characterized in that a transversely directed turret plate (91) is mounted, as a rotary part, on the end of a main shaft (90) of the activating turret (52), and in that the pockets (55), a transformer (102), a control unit (109), a control box (104), a valve block (98), at least one cable duct (86, 87) and at least one cylinder (70) are mounted on the turret plate (91).

15. An apparatus for producing packs for cigarettes, comprising:

a fixed part (93);

a rotating part (90);

individually controllable elements on the rotating part;

a first line (106) on the fixed part; and a second line (107) on the rotating part, wherein the first line and the second line each have a line end, with the line ends mutually facing each other between a central position of a hub (94) of the fixed part and a mating member (95) of the rotating part allowing transmission of control signals for the individually controllable elements between the first line and the second line without the first line and the second line contacting each other.

16. The apparatus according to claim 15, wherein each of the first line and the second line further comprises a line strand in a transition region between the first line and the second line, with the line strand of the first line and the line strand of the second line being arranged concentrically.

17. The apparatus according to claim 16, wherein the line strands are hollow lines.

18. The apparatus according to claim 15, wherein the first line and the second line are light-conducting lines and the control signals are selected from the group consisting of light signals and infrared signals.

19. The apparatus according to claim 18, wherein light signals or infrared signals of different frequencies are transmitted according to the control signal.

20. The apparatus according to claim 19, further comprising an activating turret (52), wherein the fixed part and the rotating part are components of the activating turret, and whereby the activating turret (52) activates hotmelt glue on at least one blank (11) of a pack (10).

21. The apparatus according to claim 20, wherein the activating turret further comprises at least one pocket (55) having at least one heating and pressure exerting element for pressing onto the pack or the at least one blank in the region where the hot-melt glue is located on the pack or the at least one blank.

22. The apparatus according to claim 21, wherein the heating and pressure-exerting element are selected from the group consisting of (i) lateral heating elements (62) for activating a strip of the hot-melt glue and (ii) mutually opposite heating element (72, 73) for activating a region of the hotmelt glue (45, 46) and wherein the heating and pressureexerting elements are movable relative to the pockets (55) or the pack (10) and can butt against the plurality of pack (10) for the transmission of heat and pressure.

23. The apparatus according to claim 22, wherein each heating and pressure-exerting element further comprises a heating cartridge (64, 74) and a heat sensitive sensor (83) for establishing the temperature of the heating and pressure exerting element.

24. The apparatus according to claim 20, characterized in that the heating and pressure-exerting element is movable by pivoting a mounted lever (66) such that all the heating and pressure-exerting elements are actuated by a common actuating cylinder (70) by the lever.

25. The apparatus according to claim 24, further comprising a co-rotating control unit (109) assigned to the second line (107), and at least one control line leading to at least one component selected from the group consisting of the cylinders for actuating the heating and pressure-exerting elements, the heat-sensitive sensors, to and the heating cartridges (64, 74).

26. The apparatus according to claim 25, further comprising a common feed line (96) for supplying compressed air to the cylinders via the hub and the mating member, and a valve block (98) that is common to all of the cylinders, wherein the valve block is connected to compressed-air lines (88) assigned to each cylinder for transmitting the compressed air to the cylinders, and the valve block is controlled by the control unit (109) via a control line (110).

27. The apparatus according to claim 26, further comprising a transformer (102), located in the rotating part of the activating turret, for supplying electric current to the heating cartridges of the heating and pressure-exerting elements, wherein the electric current is supplied via a common current-conducing line (101) from the hub via slip rings (100) and sliding contacts, and wherein an electrical line (103) leads from the transformer to a control box (104), to which is connected a connecting line (105) for each of the heating cartridges (64, 74) or for each of the pockets (55).

28. The apparatus according to claim 27, further comprising a common annular cable duct (87) and sensor lines (84, 85), wherein the sensor lines lead in one direction to sensors (83) for establishing the temperature of the heating and pressure-exerting element located in the pockets (55) and lead in another direction to a common annular cable duct (87), and wherein control lines (112) from the control unit (109) are connected to the cable duct (87).

29. The apparatus according to claim 28, wherein (i) the rotating part is a transversely directed turret plate (91) mounted on the end of a main shaft (90) of the activating turret, and (ii) the pockets, the transformer, the control unit, the control box, the valve block, the cable ducts, and the cylinders are mounted on the turret plate.

30. The apparatus according to claim 20, wherein the pockets (55) of the activating turret (52) further comprise axis-parallel hollow bodies with cross-sectionally predominantly closed pocket walls (57, 58, 59, 60) and the heating and pressure exerting elements are arranged in the region of cutouts of an outer wall (59) and of a top wall (60).

31. The apparatus according to claim 30, wherein the pockets (55) of the activating turret (52) are designed for receiving a plurality of packs (10) located one beside the other in the longitudinal direction, and the heating and pressureexerting elements are positioned in the region of one pack (10) that has newly been pushed into the pocket (55).

32. The apparatus according to claim 15, further comprising separate transmitters (117) and receivers (118) located at the end of the first line and the second line for transmitting of the control signals between the first line and the second line.

* * * * *